US006497001B2

(12) United States Patent
Di Nunzio et al.

(10) Patent No.: US 6,497,001 B2
(45) Date of Patent: Dec. 24, 2002

(54) HAND-HELD VACUUM CLEANER WITH A DETACHABLE HEAD

(75) Inventors: David Di Nunzio, Mentor, OH (US); John S. Murphy, Brookpark, OH (US); Michael F. Wright, Stow, OH (US); Jeffrey M. Kalman, Cleveland Heights, OH (US); Craig M. Saunders, Rocky River, OH (US); Richard C. Farone, Willoughby, OH (US); Robert A. Matousek, Lakewood, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/759,512

(22) Filed: Jan. 12, 2001

(65) Prior Publication Data

US 2002/0092118 A1 Jul. 18, 2002

(51) Int. Cl.[7] ..... A47L 5/26

(52) U.S. Cl. ..... 15/323; 15/329; 15/344

(58) Field of Search ..... 15/328, 323, 329, 15/338, 344

(56) References Cited

U.S. PATENT DOCUMENTS

| | | | | | |
|---|---|---|---|---|---|
| 1,997,754 | A | * | 4/1935 | Sharp | 15/314 |
| 2,072,690 | A | | 3/1937 | Smellie | |
| 2,202,989 | A | | 6/1940 | Kitto | |
| 2,346,339 | A | * | 4/1944 | Vose | 15/344 |
| 2,890,264 | A | | 6/1959 | Duff | |
| 2,963,750 | A | | 12/1960 | Pavlic | |
| 2,998,474 | A | | 8/1961 | Pavlic | |
| 3,310,828 | A | * | 3/1967 | Clark et al. | 15/328 |
| 3,387,319 | A | | 6/1968 | Ferraris et al. | |
| 3,790,987 | A | * | 2/1974 | MacFarland | 15/328 |
| 4,357,730 | A | * | 11/1982 | Lex | 15/344 |
| 4,393,536 | A | * | 7/1983 | Tapp | 15/327.5 |
| 4,573,237 | A | | 3/1986 | Kochte et al. | |
| 4,633,543 | A | | 1/1987 | Sovis et al. | |
| 4,652,063 | A | | 3/1987 | Genoa et al. | |
| 4,741,070 | A | | 5/1988 | Sovis et al. | |
| 4,766,638 | A | | 8/1988 | McDowell | |
| 4,841,594 | A | | 6/1989 | Elson et al. | |
| 4,881,909 | A | | 11/1989 | Blackman | |
| 4,905,342 | A | * | 3/1990 | Ataka | 15/327.7 |
| 4,939,810 | A | | 7/1990 | Ataka | |
| 4,942,641 | A | | 7/1990 | Gerke, Jr. et al. | |
| 4,951,348 | A | | 8/1990 | Krasznai et al. | |
| 4,993,108 | A | * | 2/1991 | Genge et al. | 15/338 |
| 5,129,128 | A | | 7/1992 | Bowerman et al. | |
| 5,307,537 | A | | 5/1994 | Essex et al. | |
| 5,337,443 | A | | 8/1994 | Steinberg et al. | |
| 5,379,483 | A | | 1/1995 | Pino | |
| 5,388,303 | A | * | 2/1995 | Hemmann et al. | 15/334 |
| 5,416,270 | A | | 5/1995 | Kanao | |
| 5,504,970 | A | * | 4/1996 | Neshat et al. | 15/334 |
| 5,561,885 | A | | 10/1996 | Zahuranec et al. | |
| 5,584,436 | A | | 12/1996 | Sepke | |
| 5,586,358 | A | * | 12/1996 | Wolfe et al. | 15/334 |
| 5,787,546 | A | * | 8/1998 | Bass et al. | 15/334 |
| 5,970,572 | A | | 10/1999 | Thomas | |
| 5,983,443 | A | | 11/1999 | Redding | |
| 6,122,796 | A | * | 9/2000 | Downham et al. | 15/328 |

* cited by examiner

*Primary Examiner*—Chris K. Moore
(74) *Attorney, Agent, or Firm*—Fay, Sharpe, Fagan, Minnich & McKee, LLP

(57) ABSTRACT

A hand-held vacuum cleaner includes a housing, a suction fan and a first motor assembly located in the housing and a dirt container detachably mounted on the housing. A suction nozzle is selectively mounted on the housing and is usable both in an attached position and in a detached position for cleaning. A brushroll and a second motor are mounted within the suction nozzle. An electrified hose is connected to the housing and to the suction nozzle. The dirt container includes an inlet in fluid communication with the electrified hose, and an outlet in fluid communication with the suction fan and first motor assembly. A filter assembly is releasably positioned for form an outlet of the dirt container. The dirt container has a latching mechanism for securing the dirt container to the housing. The housing further includes a hollow section formed above the suction fan and first motor assembly for storing a cleaning attachment.

33 Claims, 10 Drawing Sheets

HAND-HELD VACUUM CLEANER WITH A DETACHABLE HEAD

BACKGROUND OF THE INVENTION

The present invention relates to a portable hand-held vacuum cleaner. More particularly, the present invention relates to a hand-held vacuum cleaner with a powered rotary brush within a detachable head for suctioning dirt and debris from carpets, floors, and above-floor surfaces.

Portable hand-held vacuum cleaners have become extremely popular for cleaning a variety of surfaces in homes, offices, cars or the like. They are utilized typically for small clean-up jobs or for cleaning in hard-to-reach places. These portable vacuum cleaner units are relatively light weight and have a handle in order to enable a user to readily utilize them in places where canister, upright or shop-type vacuum cleaners cannot be used or are inconvenient to use.

While such prior art portable hand-held vacuum cleaners have worked well for their intended purposes, they have been primarily useful for picking up light weight dry debris, such as dust and small particulate matter. Where heavier and more dense particulate matter is encountered, they have been less effective. In fact, even where dust or other lighter particulate matter are desired to be picked up or collected, the overall efficiency and effectiveness of the prior vacuum cleaners has been less than desired.

Another limiting factor of some prior art portable vacuums is the efficiency and effectiveness of the airflow path through the vacuum cleaner units, while depositing debris in a debris canister or container.

Some prior art hand-held vacuum cleaner units do not include brushes which would help loosen dirt or debris from the surface being cleaned prior to vacuuming. Furthermore, the prior art hand-held vacuums do not have a detachable head for vacuuming in hard-to-reach places or tight places where even a hand-held vacuum cleaner cannot fit.

Other hand-held vacuums are difficult to use in that they are awkward to service. Others are expensive to produce in that they have complex reciprocating brush mechanisms.

Accordingly, it is desirable to develop a new and improved hand-held vacuum cleaner which would overcome the foregoing deficiencies and others while meeting the above-stated needs and providing better and more advantageous overall results.

SUMMARY OF THE INVENTION

The present invention relates to a new and improved hand-held vacuum cleaner. More specifically, the hand-held vacuum cleaner has a detachable head or suction nozzle which houses a powered brushroll for loosening dirt and debris from a surface to be cleaned.

According to one aspect of the invention, the hand-held vacuum cleaner comprises a housing having a first end and a second end. A suction fan and a first motor assembly are housed within the housing. A dirt container is detachably mounted on the housing second end, and a suction nozzle is selectively mounted at the housing first end. The suction nozzle is usable both in an attached position and in a detached position for cleaning.

The suction nozzle has a handle. At least one air outlet is provided in a wall of the housing for allowing air to exhaust from the housing and for venting and cooling the motor. The housing further comprises a hollow section formed above the suction fan and first motor assembly for storing a cleaning attachment. A handle is secured to a top surface of the housing.

A brushroll and a second motor are housed within the suction nozzle. An electrified hose is connected at a first end to the suction nozzle and at a second end to the housing second end. The second motor is operatively connected to the electrified hose first end and to the brushroll.

The dirt container defines a dirt and dust collecting chamber. The dirt container comprises an inlet in fluid communication with the electrified hose, and an outlet in fluid communication with the suction fan and first motor assembly. A filter assembly is releasably positioned to form a wall and outlet of the dirt container. The filter assembly comprises a filter and a filter frame. The dirt container further comprises a latching mechanism for securing the dirt container to the housing second end.

One aspect of the present invention is the provision of a new and improved hand-held vacuum cleaner.

Another aspect of the present invention is the provision of a hand-held vacuum cleaner that includes a detachable suction nozzle.

According to still another aspect of the present invention, a hand-held vacuum cleaner has a detachable suction nozzle or "head" which houses a rotatable brushroll and a motor for powering the brushroll.

Yet another aspect of the present invention is the provision of a hand-held vacuum cleaner including an electrified hose for providing power to a motor located within a detachable suction nozzle.

Yet still another aspect of the present invention is the provision of the suction nozzle that is detachable from a housing of a vacuum cleaner and is usable in an attached or in a detached position.

Still other benefits and advantages of the invention will become apparent to those skilled in the art upon reading and understanding the following detailed description.

BRIEF DESCRIPTION OF THE DRAWINGS

The invention may take form in certain components and structures, one embodiment of which will be illustrated in the accompanying drawings wherein.

DETAILED DESCRIPTION OF THE EMBODIMENT

Figure 1:
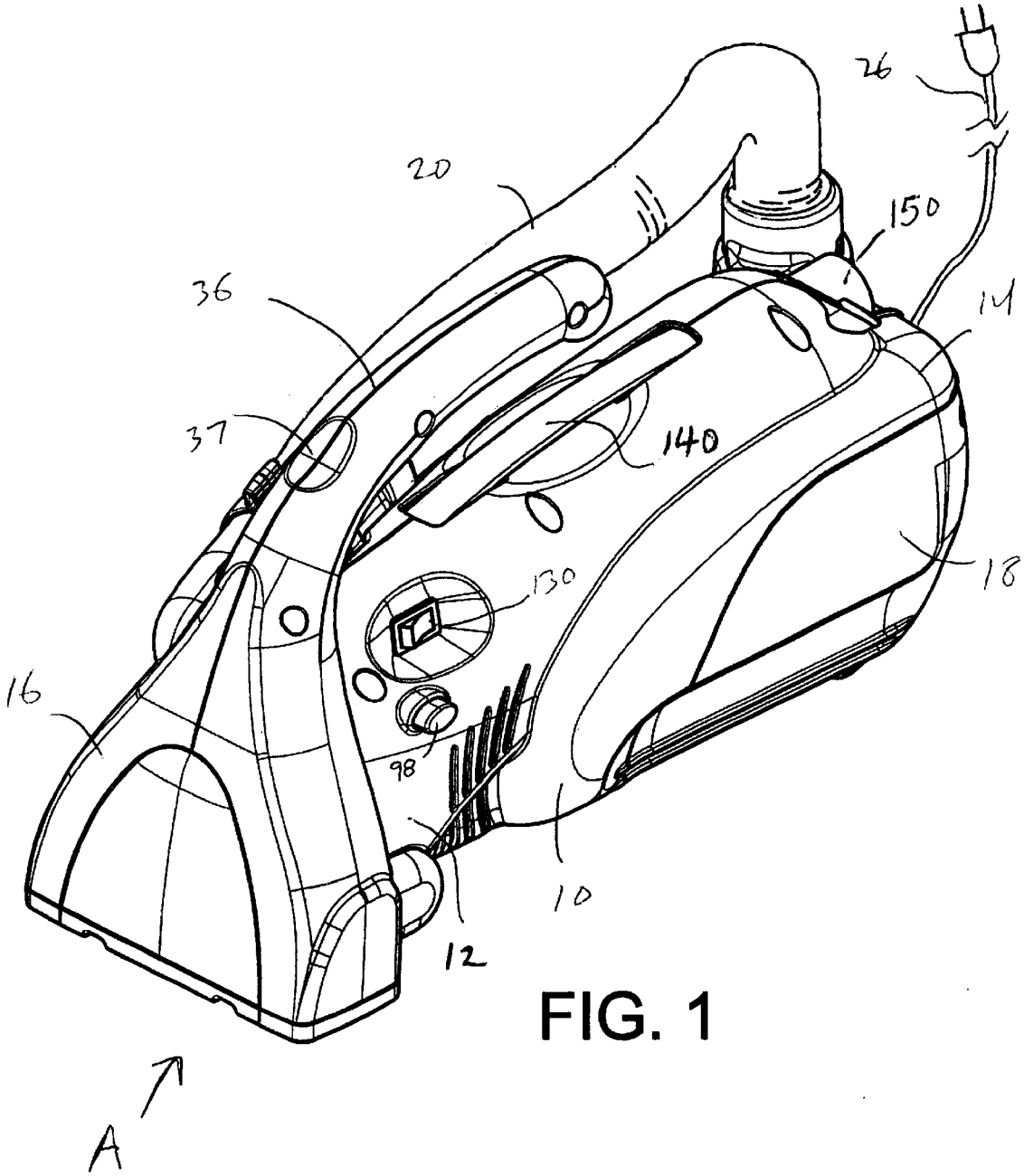
FIG. 1 is a perspective view of the hand-held vacuum cleaner according to one embodiment of the present invention.

Referring now to the drawings, wherein the showings are for purposes of illustrating an embodiment of this invention only and not for purposes of limiting same, FIG. 1 shows a hand-held vacuum cleaner A according to one embodiment of the present invention.

Figure 2:
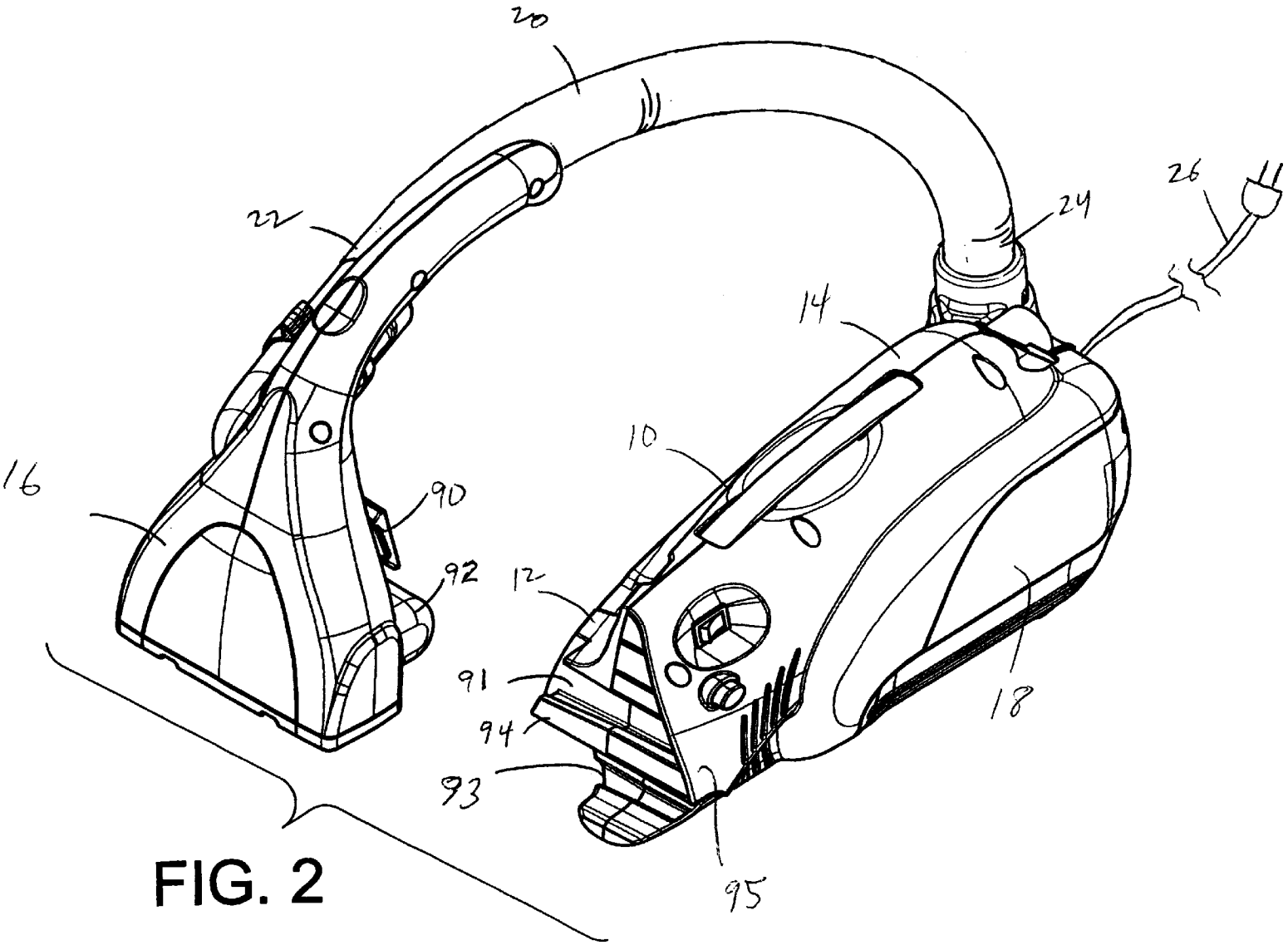
FIG. 2 is a perspective view of the vacuum cleaner of FIG. 1 with a detachable head separated from a housing.

The hand-held vacuum cleaner A includes a housing 10 having a first end 12 and a second end 14. A suction nozzle or head 16 is selectively mounted at the housing first end 12 and is usable in both an attached position (shown in FIG. 1) and in a detached position (shown in FIG. 2) for cleaning. A dirt cup or container 18 is detachably mounted on the second end 14 of the housing.

A conventional flexible, elongated electrified hose 20 connects at a first end 22 to the suction nozzle 16 and at a second end 24 to the housing second end 14 and then to the dirt container 18. The hose 20 is electrically conductive to provide power to a motor housed within the suction nozzle.

The hose 20 has at its ends 22 and 24 conductors which are connected to any suitable transformer relay mounted within the housing 10 and suction nozzle 16, respectively, and electrically connected to a first motor 110 within the housing 10 and to a second motor 70 within the suction nozzle 16, respectively. It is well known in the prior art to use an electrically conductive hose for powering a motor in a vacuum cleaner. A power cord 26 is connected to the housing 10 to power the hand-held vacuum cleaner.

Figure 3:
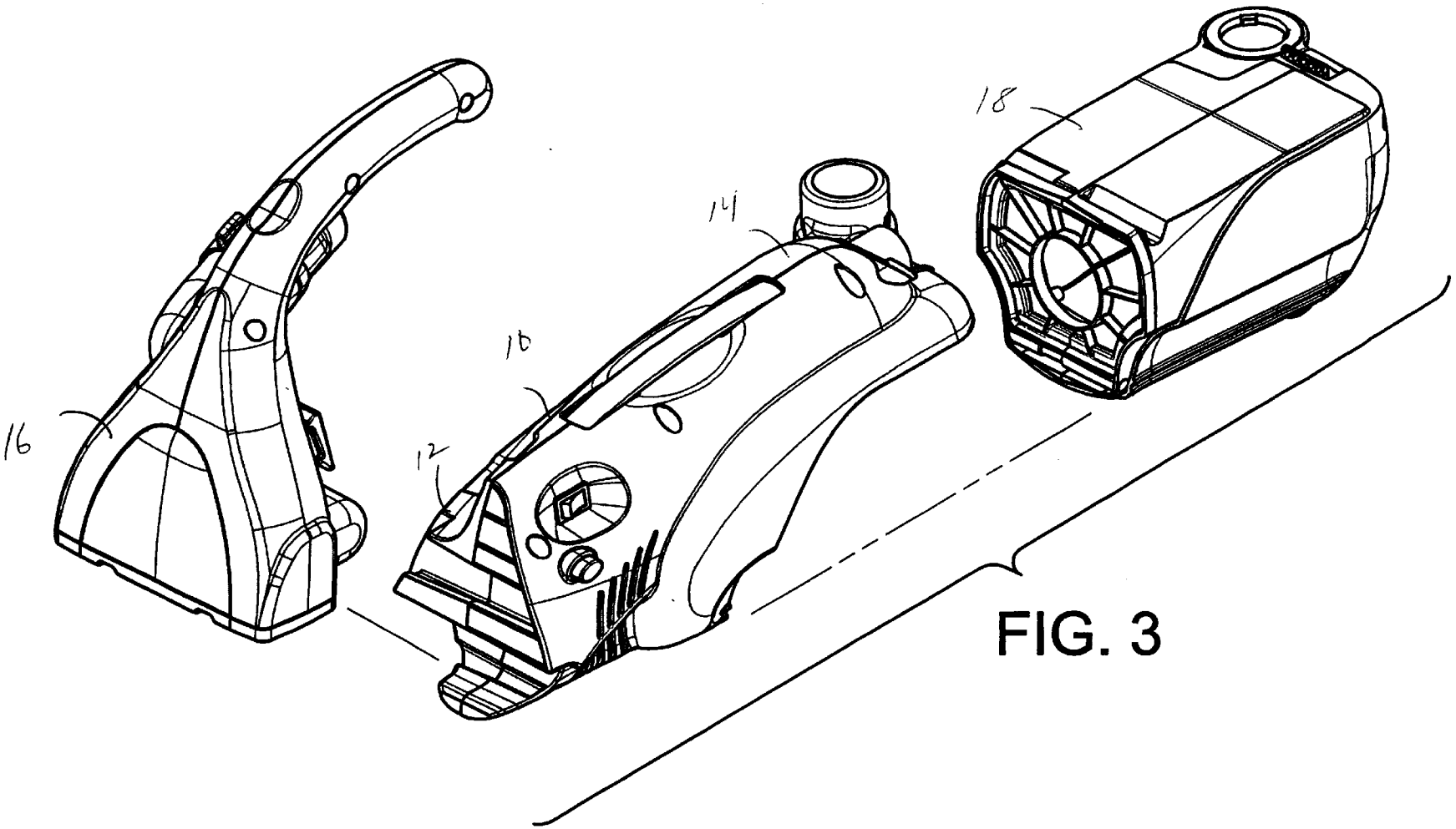
FIG. 3 is a perspective view of the detachable head and a dirt container separated from the housing.
Figure 4:
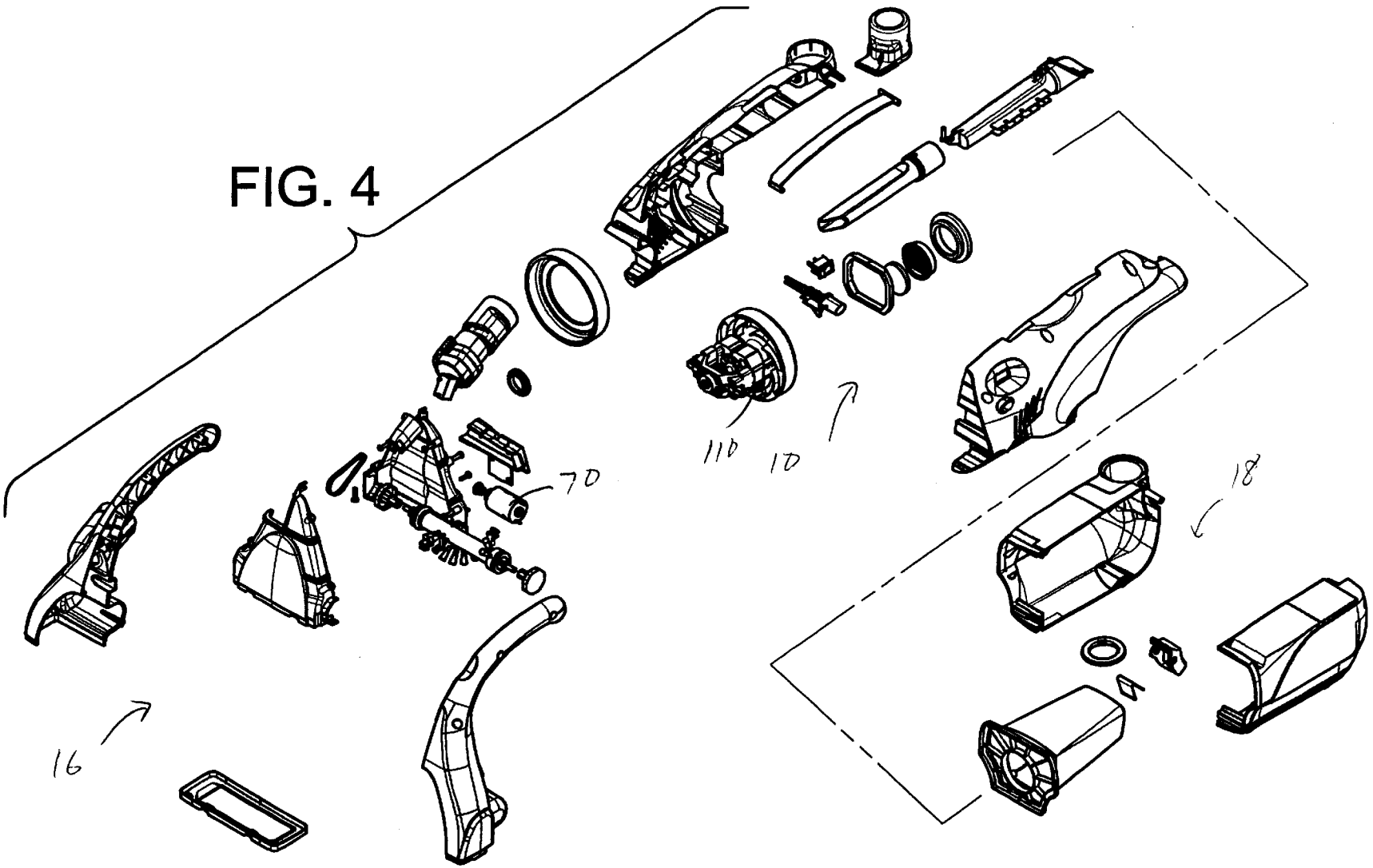
FIG. 4 is an exploded perspective view of the hand-held vacuum cleaner of FIG. 1.

Referring to FIG. 3, the hand-held vacuum cleaner has three main components: the detachable head or suction nozzle 16, the housing 10, and the detachable dirt container 18. FIG. 4 illustrates the internal parts of each of these components.

Figure 5:
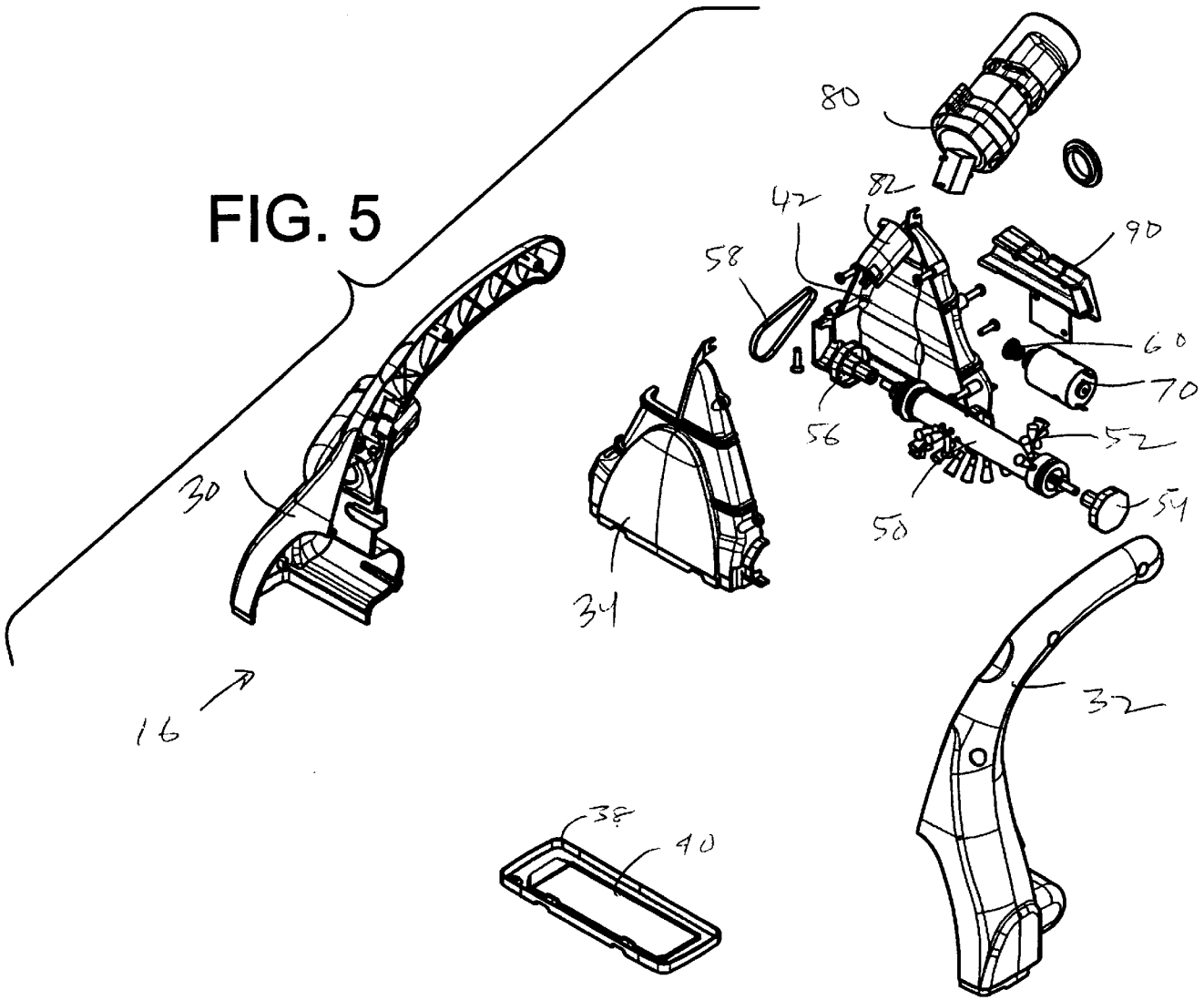
FIG. 5 is an enlarged, exploded perspective view of the detachable head and a brushroll assembly of the hand-held vacuum cleaner of FIG. 1.

Referring now to FIG. 5, the suction nozzle 16 is comprised of a first housing portion 30 and a second housing portion 32 which are fastened together by suitable fasteners (not shown). A nozzle portion 34 is attached between the first housing portion 30 and the second housing portion 32. The first and second housing portions 30 and 32, when assembled, form a handle 36. The handle 36 may have a curved shape as shown in FIG. 1. An indentation 37 can be added onto a top surface of the handle 36 to allow the user to place a thumb or other finger in the indentation to aid in gripping the handle.

A bottom plate 38 is mounted below nozzle portion 34 and defines an opening 40. The opening 40 serves as a suction opening through which dirt, dust and other debris is suctioned into the nozzle 16. A back plate 42 is mounted onto the housing portions 30 and 32 to define the interior of the suction nozzle. If desired, the suction nozzle 16 can be fabricated from a thermoplastic material.

A conventional brushroll 50 is rotatably mounted within the suction nozzle 16. Bristles 52 extend along the circumference of brushroll 50. Bearings 54, 56 are mounted on opposite ends of the brushroll 50 and are mounted onto inside surfaces of the nozzle 16 to aid in rotation of the brushroll 50. A belt 58 is looped around the brushroll 50 and also around a cogged pulley 60 mounted on an output shaft of a motor 70 also housed within the suction nozzle 16. The belt 58 is toothed to engage the cogged pulley 60 and also an appropriately cogged peripheral portion 61 of the brushroll.

The electrified hose 20 is attached to the suction nozzle through a sleeve 80. The sleeve 80 protects the electrical connectors of the hose. The hose 20 is secured into place by rotating a locking cuff 81 on the hose to a locked position. The hose 20 is connected by a connector 82 to motor 70 for powering the motor.

With reference now to FIGS. 2, 9A, 9B, 10A and 10B, a plate 90 is mounted on the back plate 42 of the suction nozzle 16 for slidably engaging a slot 91 in the housing 10. A raised, curved portion 92 of the nozzle also engages a second slot 93 in the housing 10. Raised portion 92 also houses the motor 70 of suction nozzle. The nozzle is secured to the housing through the engagement of the plate 90 and raised portion 92 with slots 91, 93. The slot 91 is tapered from an inlet side 94 of the housing 10 to ensure that the head 16 cannot slide through the slot. Wall 95 also serves to block or stop head 16 from sliding completely through the slot 91. A tab 96 extends into slot 91 and engages a notch 97 in plate 90 and locks the head 16 in place. As the plate 90 enters slot 91, plate 90 pushes on a spring bias on tab 96 thus retracting the tab 96 into the housing. When notch 97 aligns with the tab 96, tab 96 then releases into engagement with the area of notch 97. A conventional linkage connects the tab 96 to a locking button 98. A tab 99 on raised portion 92 also engages a groove 101 in slot 93. When the nozzle is to be removed from the housing, button 98 is depressed to retract tab 96 and allow head 16 to be pulled out of slots 91, 93 and be removed from the housing 10.

Figure 6:
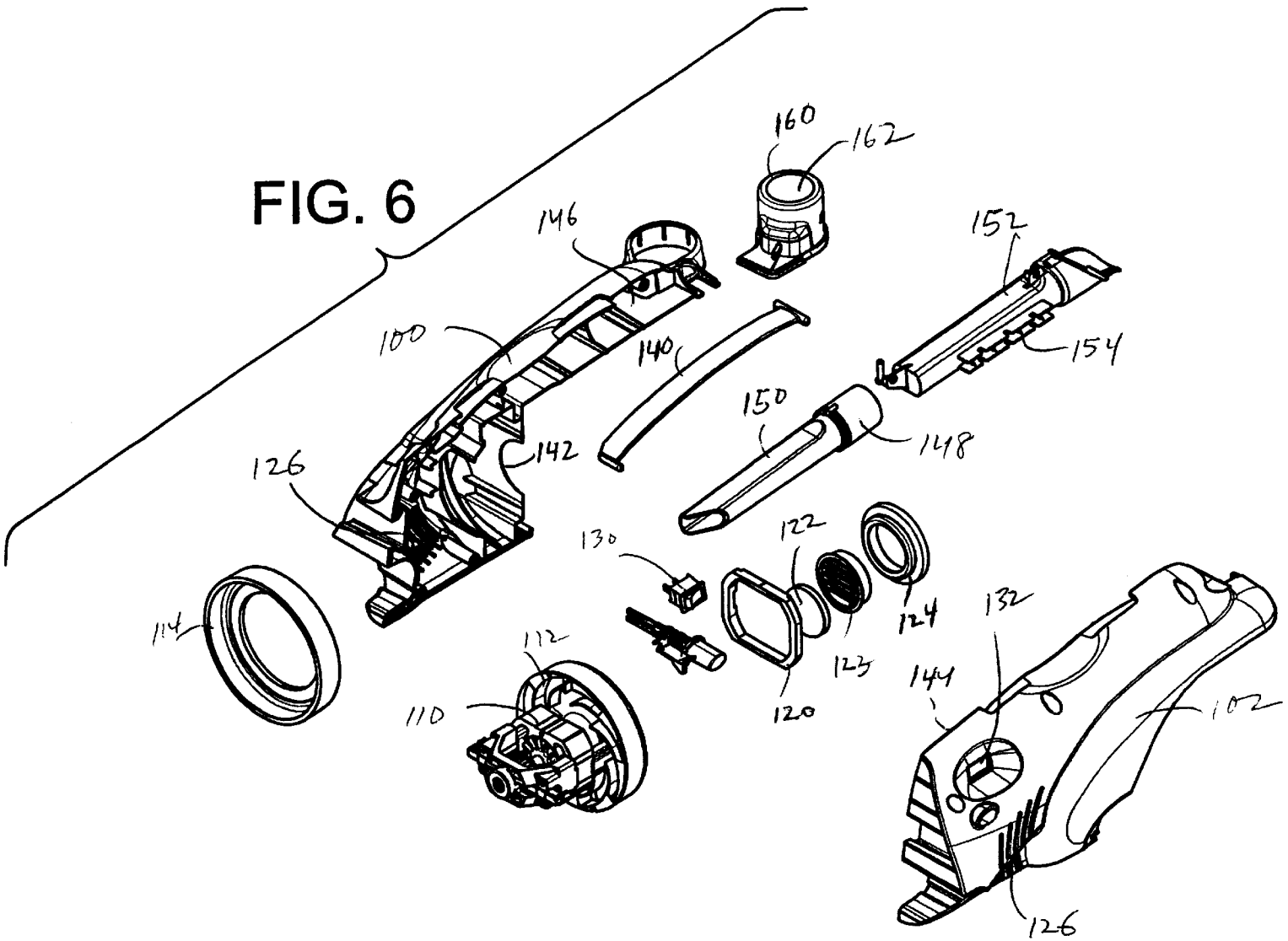
FIG. 6 is an enlarged, exploded perspective view of the housing of the hand-held vacuum cleaner of FIG. 1.

Referring now to FIG. 6, the housing 10 will now be described. The housing 10 comprises a first housing half 100 and a second housing half 102 which are fastened together by suitable fasteners (not shown). If desired, the housing can be fabricated from a thermoplastic material. A suction motor 110 and fan 112 are mounted within the housing 10. A cap 114 is mounted in the housing halves to secure the motor and fan in place. A filter assembly is mounted adjacent the suction fan and motor. The filter assembly comprises a first frame member 120, a filter 122, a second frame member 123 and a cap 124. The filter serves to filter air before it is drawn into the motor 110 by the fan 112.

Outlet slots 126 are provided on the first and second housing halves 100 and 102 for allowing an exhaust of air from the housing and for providing ventilation and cooling of the suction motor 110. A switch 130, which protrudes through opening 132 of the second housing half 102, is provided for selectively powering the motor 110 as well as the motor 70 (FIG. 5). The housing 10 further comprises a handle strap 140 which is mounted to a top surface of the housing.

Cooperating openings 142 (only one of which is visible) in the housing halves 100, 102 allow air from the dirt container to be pulled in by the suction fan 112 through the filter 122. Cooperating rear portions 146 (only one of which is visible) of the housing halves 100, 102 mount a sheath 152 in which is slidably received a cleaning attachment or crevice tool 150. The sheath also forms an inlet mount 154 for the power cord 26 (FIG. 1) of the vacuum cleaner. Suitable wiring (not shown) connects the power cord 26 to the motor 110 and to a sleeve 160 in which the electrified hose is mounted. End 22 of the electrified hose 20 is pulled out of the suction nozzle 16 and is slidably mounted in an inlet end 148 of the cleaning attachment 150 for above-floor cleaning.

The sleeve 160 is mounted on the first housing half 100. The sleeve has an opening 162 for receiving one end of the electrified hose 20. The sleeve 160 protects the electrical connections of the hose 20 and connects the hose to the motor 70 in the suction nozzle 16.

Figure 7:
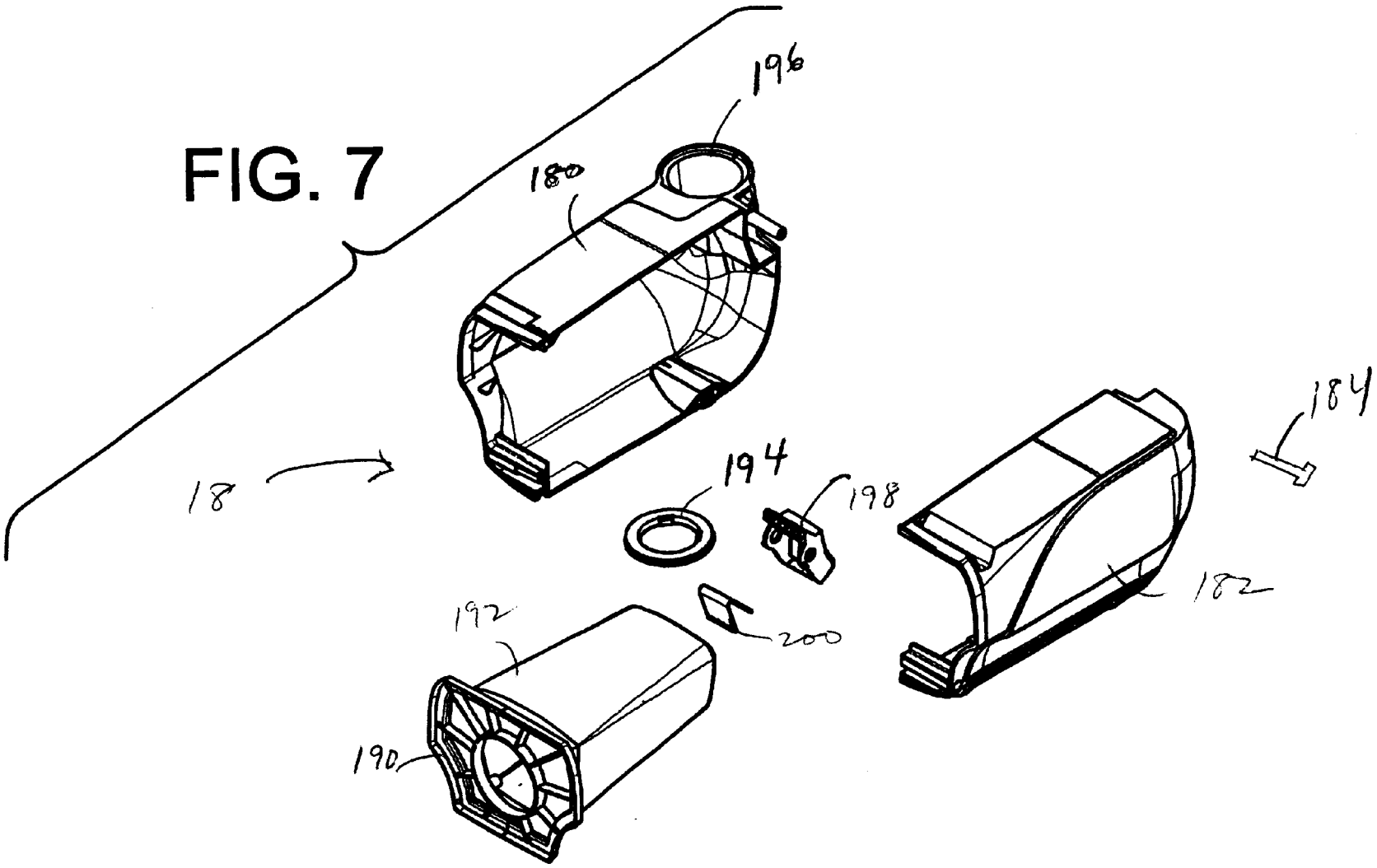
FIG. 7 is an enlarged, exploded perspective view of the dirt container of the hand-held vacuum cleaner of FIG. 1.

Referring now to FIG. 7, the dirt container 18 comprises a first container portion 180 and a second container portion 182 which are fastened together by suitable fasteners 184 to form a dirt and dust collecting chamber. If desired, the dirt container can be fabricated from a transparent thermoplastic material to enable the user to see the dirt and debris being collected in the dirt container.

Figure 8:
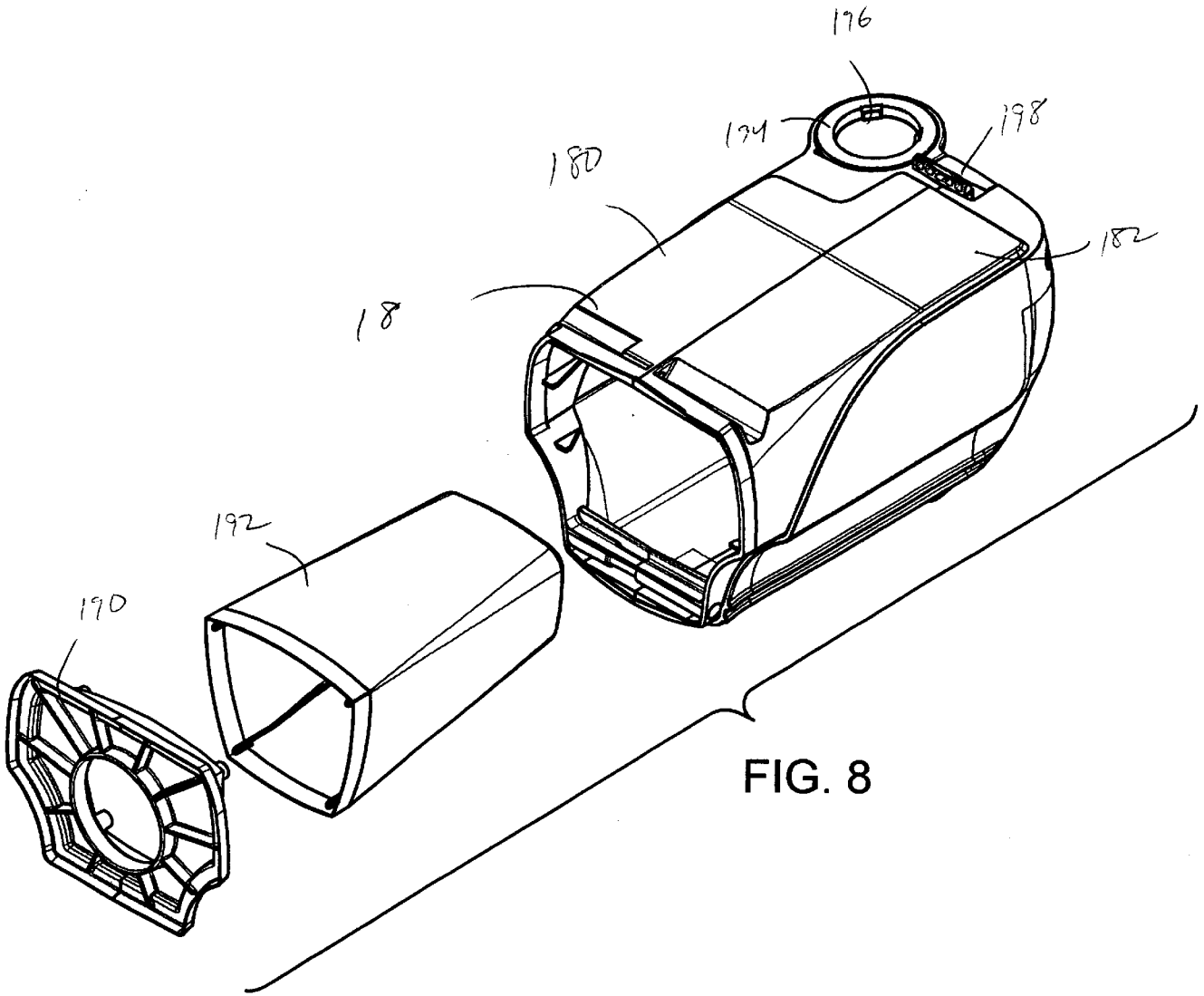
FIG. 8 is an enlarged, exploded perspective view of the dirt container of FIG. 7 in an assembled form and a filter and filter frame thereof.
Figure 9B:
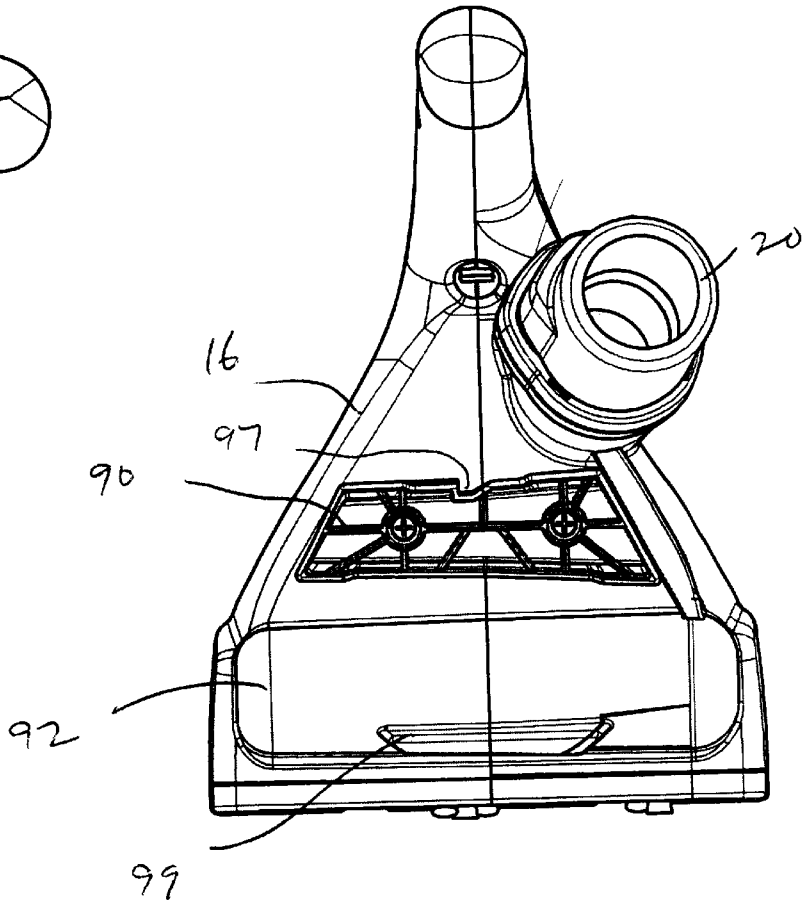
FIG. 9B is a rear elevational view of the detachable head of FIG. 9A.
Figure 9A:
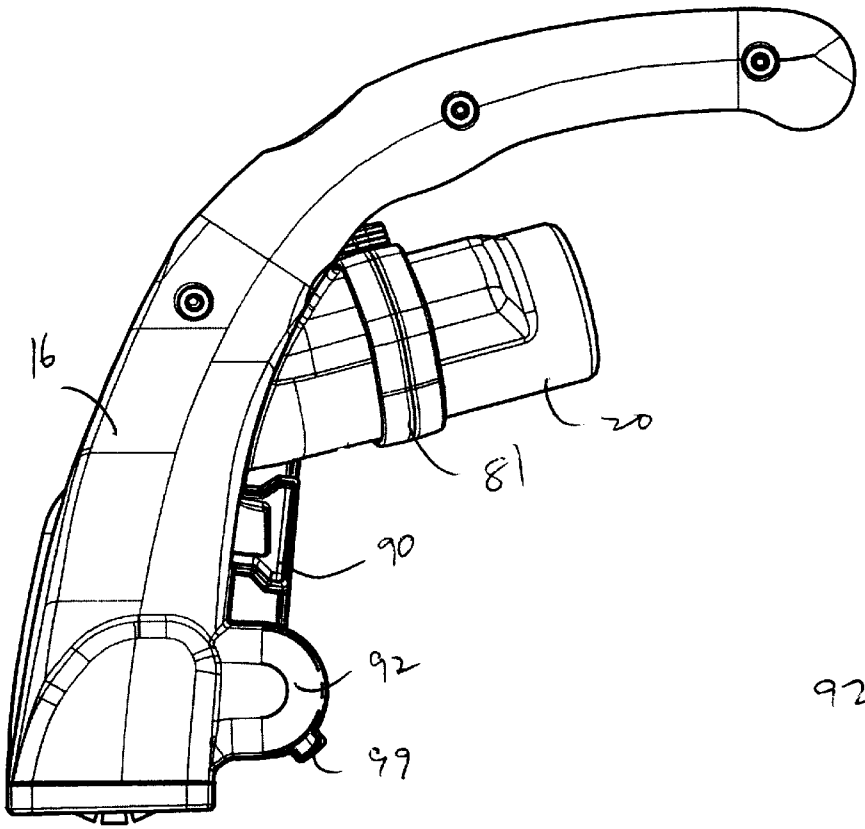
FIG. 9A is a side elevational view of the detachable head of the vacuum cleaner of FIG. 1.
Figure 10B:
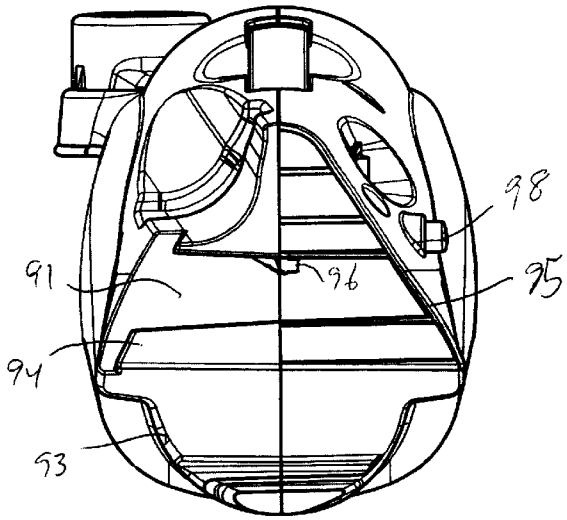
FIG. 10B is a front elevational view of the housing of FIG. 10A.
Figure 10A:
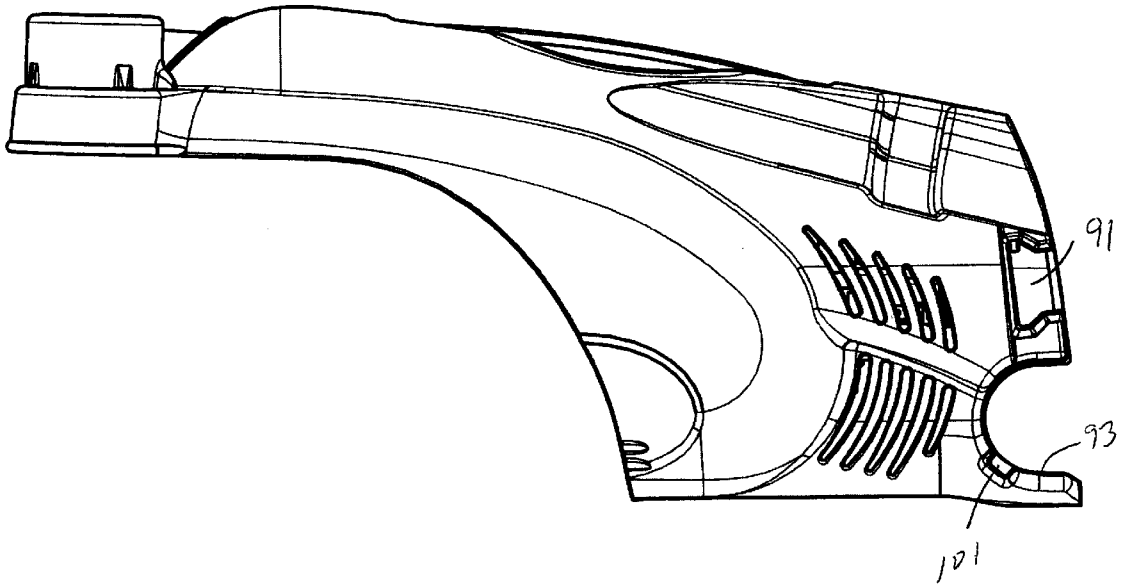
FIG. 10A is a side elevational view of the housing of the vacuum cleaner of FIG. 1.

As shown in FIG. 8, filter frame 190 and filter 192 form a filter assembly releasably positioned in the dirt container 18 to form a wall and outlet of the dirt container. The filter 192 is removable from the filter frame 190 for replacing the filter. The filter assembly is removed from the dirt container to allow emptying of dirt and debris collected within the dirt container. The outlet formed by the filter is adjacent to and in fluid communication with the suction fan and motor assembly 110, 112 within housing 10.

A ring 194 is mounted above an opening 196 in the first container portion to form an inlet which is in fluid communication with the electrified hose 20. A latch 198 is mounted with a clip 200 to the cooperating container portions 180, 182 to detachably secure the dirt container to a catch (not shown) on the housing second end 14.

The hand-held vacuum cleaner operates as follows. The electrified hose 20 is threaded or slidably connected at a first end 22 to the suction nozzle 16 and at a second end 24 to the housing 10. The suction nozzle 16 may be used attached to the housing (see FIG. 1) or in a detached position (see FIG. 2). The suction nozzle 16 would be used in a detached position to facilitate easier cleaning of stairs, room corners, crevices in sofas and chairs, etc.

The dirt container 18 is secured to the housing through the latch 198 which engages a catch (not shown) on the housing second end 14. The switch 130 is depressed to an "on" position, thus powering the suction fan 112 and motor 110 assembly. The switch 130 also provides power to the hose 20, thus electrifying the hose. The hose 20 in turn provides power to the motor 70 within the suction nozzle 16. The motor 70 causes the brushroll 50 to rotate through the use of the toothed belt 58. The brushroll 50 loosens dirt and debris on the surface being cleaned, enabling easier suctioning of the dirt from the surface.

The suction fan 112 and motor 110 produce an airflow which travels through the suction nozzle opening 40 into the hose 20 and then into opening 196 of the dirt container. As the dirt and airflow are drawn into the dirt container chamber, dirt is deposited in the dirt container upstream of the filter 192. The filter 192 and its frame 190 prevent the dirt and debris from entering the suction fan and motor assembly.

Air is exhausted from the housing 10 through air outlets 126, serving at the same time to cool the motor 110 and prevent it from overheating.

Once the cleaning of the surface is completed, the switch 130 is turned to the "off" position. Then, the dirt container 18 can be removed from the housing by depressing the latch 198. The filter 192 and filter frame 190 are removed from the dirt container thus allowing the dirt container to be emptied of dirt and debris.

The invention has been described with reference to one embodiment. Obviously, alterations and modifications will occur to others upon a reading and understanding of this specification. It is intended to include all such modifications and alterations insofar as they come within the scope of the appended claims or the equivalents thereof.

What is claimed is:

1. A hand-held vacuum cleaner comprising:

a housing having a first end and a second end;

a suction fan and a first motor assembly located in said housing;

a dirt container detachably mounted on said housing second end;

a suction nozzle selectively mounted adjacent said housing first end and usable both in an attached position and in a detached position for cleaning;

a hose connected at a first end to said suction nozzle and at a second end to said housing adjacent said second end;

said dirt container comprising:

an inlet being in fluid communication with said second end of said hose, and an outlet being in fluid communication with said suction fan and first motor assembly.

2. The hand-held vacuum cleaner of claim 1 further comprising a brushroll housed within said suction nozzle.

3. The hand-held vacuum cleaner of claim 2 further comprising a second motor within said suction nozzle, wherein said second motor is operatively connected to said hose and to said brushroll for powering said brushroll.

4. The hand-held vacuum cleaner of claim 1 further comprising at least one air outlet in a wall of said housing for allowing an exhaust of air from said housing.

5. The hand-held vacuum cleaner of claim 1 further comprising a filter assembly releasably positioned to form said outlet of said dirt container, said filter assembly comprising a filter and a filter frame.

6. The hand-held vacuum cleaner of claim 1 wherein said dirt container further comprises a latching mechanism for securing said dirt container to said housing second end.

7. The hand-held vacuum cleaner of claim 1 wherein said housing further comprises a hollow section formed above said suction fan and first motor assembly, said hollow section receiving an above-floor cleaning attachment.

8. The hand-held vacuum cleaner of claim 1 wherein said housing further comprises a handle secured to a top surface of said housing.

9. The hand-held vacuum cleaner of claim 1 wherein said housing is comprised of a first portion and a second portion which are secured to each other.

10. The hand-held vacuum cleaner of claim 1 wherein said suction nozzle comprises a handle.

11. A hand-held vacuum cleaner comprising:

a housing having a first end and a second end, said housing further comprising a handle secured to a top surface of said housing;

a suction source housed within said housing;

a dirt container detachably mounted on said housing adjacent said second end, wherein said dirt container defines a dirt and dust collecting chamber;

a suction nozzle selectively mounted adjacent said housing first end, said suction nozzle comprising a brushroll housed within said suction nozzle;

a hose connected at a first end to said motor housed within said suction nozzle and at a second end to said suction source, said dirt container comprising:

an inlet in fluid communication with said second end of said hose, and an outlet in fluid communication with said suction source.

12. The hand-held vacuum cleaner of claim 11 further comprising at least one air outlet in a wall of said housing for allowing an exhaust of air from said housing.

13. The hand-held vacuum cleaner of claim 11 further comprising a filter assembly releasably positioned adjacent said outlet of said dirt container, said filter assembly comprising a filter and a filter frame.

14. The hand-held vacuum cleaner of claim 11 wherein said dirt container further comprises a latching mechanism for securing said dirt container to said housing second end.

15. The hand-held vacuum cleaner of claim 11 wherein said suction nozzle comprises a handle.

16. A hand-held vacuum cleaner comprising:

a housing having a first end and a second end;

a dirt container detachably mounted on said housing adjacent said second end thereof;

a suction nozzle detachably mounted adjacent said housing first end, said suction nozzle comprising a brushroll and a mechanism for rotating said brushroll; and a hose connected at a first end to said suction nozzle and at a second end to said housing, wherein said dirt container comprises an inlet in fluid communication with said hose, an outlet, and a filter releasably positioned on said dirt container adjacent said outlet.

17. The hand-held vacuum cleaner of claim 16 wherein said hose comprises an electrified hose which is slidably mounted at said hose first end to said suction nozzle and at said hose second end to said housing.

18. The hand-held vacuum cleaner of claim 16 further comprising a suction fan and a first motor assembly located in said housing, wherein said dirt cup outlet is in fluid communication with said suction fan and said first motor assembly.

19. The hand-held vacuum cleaner of claim 18 wherein said mechanism comprises a second motor mounted in said suction nozzle, wherein said second motor is operatively connected to said brushroll for powering said brushroll.

20. The hand-held vacuum cleaner of claim 16 further comprising at least one air outlet in a wall of said housing for allowing an exhaust of air from said housing.

21. The hand-held vacuum cleaner of claim 16 wherein said filter assembly comprises a filter and a filter frame.

22. The hand-held vacuum cleaner of claim 16 wherein said suction nozzle comprises a handle.

23. The hand-held vacuum cleaner of claim 1, wherein said hose comprises an electrified hose.

24. A hand-held vacuum cleaner comprising:

a housing including a suction fan and motor assembly;

a dirt container detachably mounted to said housing;

a filter mounted in the dirt container;

a suction nozzle detachably mounted to said housing in spaced relationship to said dirt container, said suction nozzle comprising:

a brushroll, and a mechanism for rotating said brushroll; and, a hose connected at a first end to said suction nozzle and at a second end to one of said dirt container and said housing.

25. The hand-held vacuum cleaner of claim 24 wherein said dirt container comprises a dust cup made of a rigid material.

26. The hand-held vacuum cleaner of claim 24 further comprising at least one air outlet located in a wall of said housing for allowing an exhaust of air from said housing.

27. The hand-held vacuum cleaner of claim 24 wherein said dirt container further comprises a latching mechanism for securing said dirt container to said housing.

28. The hand-held vacuum cleaner of claim 24 wherein said housing further comprises a hollow section formed above said suction fan and motor assembly, said hollow section receiving an above-floor cleaning attachment.

29. The hand-held vacuum cleaner of claim 24 wherein said housing further comprises a handle secured to a top surface of said housing.

30. The hand-held vacuum cleaner of claim 24, wherein said brushroll comprises bearings mounted at opposite ends of said brushroll, said bearings mounted to said nozzle for enabling a rotation of said brushroll.

31. The hand-held vacuum cleaner of claim 24 wherein said suction nozzle comprises a handle.

32. The hand-held vacuum cleaner of claim 11, wherein said hose comprises an electrified hose.

33. The hand-held vacuum cleaner of claim 11, wherein said suction nozzle further comprises a motor for rotating said brushroll.

* * * * *